United States Patent [19]

Brownlee

[11] Patent Number: 4,821,661

[45] Date of Patent: Apr. 18, 1989

[54] CHAIN STITCH SEWING MACHINE

[75] Inventor: ALfred W. T. Brownlee, Hoddeson, England

[73] Assignee: Union Special GmbH, Stuttgart, Fed. Rep. of Germany

[21] Appl. No.: 168,843

[22] Filed: Mar. 16, 1988

[30] Foreign Application Priority Data

Mar. 27, 1987 [DE] Fed. Rep. of Germany ..... 3710231

[51] Int. Cl.[4] ..... D05B 49/04

[52] U.S. Cl. ..... 112/248; 112/254; 112/DIG. 3

[58] Field of Search ..... 66/125 R, 125 A, 146; 112/199, 242, 248, 254, 255, DIG. 3, DIG. 1

[56] References Cited

U.S. PATENT DOCUMENTS

| | | | |
|---|---|---|---|
| 2,944,414 | 7/1960 | Malloy et al. | 66/125 A |
| 3,014,356 | 12/1961 | Butler | 66/146 |
| 3,788,251 | 1/1974 | Haak | 112/252 |
| 3,903,821 | 9/1975 | Marforio | 112/242 |
| 4,325,314 | 4/1982 | Niem | 112/199 |
| 4,492,174 | 1/1985 | Kaufmann | 112/248 |
| 4,633,795 | 1/1987 | von Hagen | 112/248 |

FOREIGN PATENT DOCUMENTS

| | | | |
|---|---|---|---|
| 2081753 | 2/1982 | United Kingdom | 112/254 |

*Primary Examiner*—Wm. Carter Reynolds
*Attorney, Agent, or Firm*—Emrich & Dithmar

[57] ABSTRACT

A thread control device for the looper thread of a chain stitch sewing machine having a rotating thread take-up disc and a cover plate containing a slot for the thread take-up disc. To prevent broken thread being wound up on a main shaft, a tube carrying a pressure medium, such as a stream of air, is disposed between the thread take-up disc and a looper eye. Tension is thereby mantained in the looper thread even if the thread breaks downstream of the thread take-up disc.

6 Claims, 1 Drawing Sheet

CHAIN STITCH SEWING MACHINE

BACKGROUND OF THE INVENTION

The present invention relates to a thread control device for a looper thread of a chain stitch sewing machine.

A thread control device is known from German Auslegeschrift No. 24 15 991 corresponding to U.S. Pat. No. 3,903,821. Generally, the problem with such thread control devices is that, if the thread breaks in the region of the rotation take-up disc, the looper thread is caught up and wound up by said thread take-up disc. By the time the operator has noticed the break, a large quantity of thread has usually already been wound up, and is difficult and time-consuming to remove.

German Auslegeschrift No. 24 15 991 attempts to eliminate these defects using special adjusting means on the thread control device. These adjusting means are intended to prevent the thread breaking and being wound up on the take-up discs, although this cannot be ruled out.

In order to prevent broken thread being wound up, it is proposed in German Offenlegungsschrift No. 29 14 117 which corresponds to U.S. Pat. No. 4,325,314, to clamp the looper thread periodically in front of the discs, in order to be able to break it off should it start to be wound up. This additional device is, however, relatively expensive as it requires parts which move in synchronism with the stitch formation.

In a thread control device as described in German Patent Specification No. 35 10 332 which corresponds to U.S. Pat. No. 4,633,795, knives are disposed immediately adjacent to the discs beneath the cover plate in a holder, the cutting edges of which knives are substantially parallel to the rotational axis of the discs. These knives are used to cut off the looper thread, which is taken up by the discs when a thread break occurs, when said thread reaches the region of the knives, and hence to avoid winding up. These knives are prone to wear and are ineffective when their cutting edge is blunt. Furthermore, they must be very precisely adjusted in order to be effective.

SUMMARY OF THE INVENTION

A principal feature of the present invention is the provision of a simplified device for controlling a looper thread of a chain stitch sewing machine.

The device of the invention comprises, a rotating thread take-up disc, a cover plate having a slot through which the thread take-up disc protrudes and moves between thread guiding elements into the path of the thread, and a looper having a thread eye, the thread guiding elements including a tube disposed between the thread take-up disc and the thread eye on the looper, such that the looper thread passes through the tube.

A feature of the present invention is that the device prevents broken thread from being wound up.

Another feature of the invention is the provision of means for passing a pressure medium through the tube to impart tension to the looper thread to at least compensate for the frictional force of the looper thread on the thread take-up disc.

A feature of the invention is that as a result of the formation of a thread guide element between the thread take-up disc and the thread eye on the looper as a tube carrying the fluid medium and accomodating the looper thread, winding up is prevented in the event of the thread breaking, as tension is maintained in the looper thread to at least compensate for the frictional force of said thread on the thread take-up disc. The broken thread is thus advantageously prevented from being wound up without the use of moving sewing machine parts.

Further features will become more fully apparent in the following description of the embodiments of this invention and from the appended claims.

DESCRIPTION OF THE PREFERRED EMBODIMENTS

Figure 1:
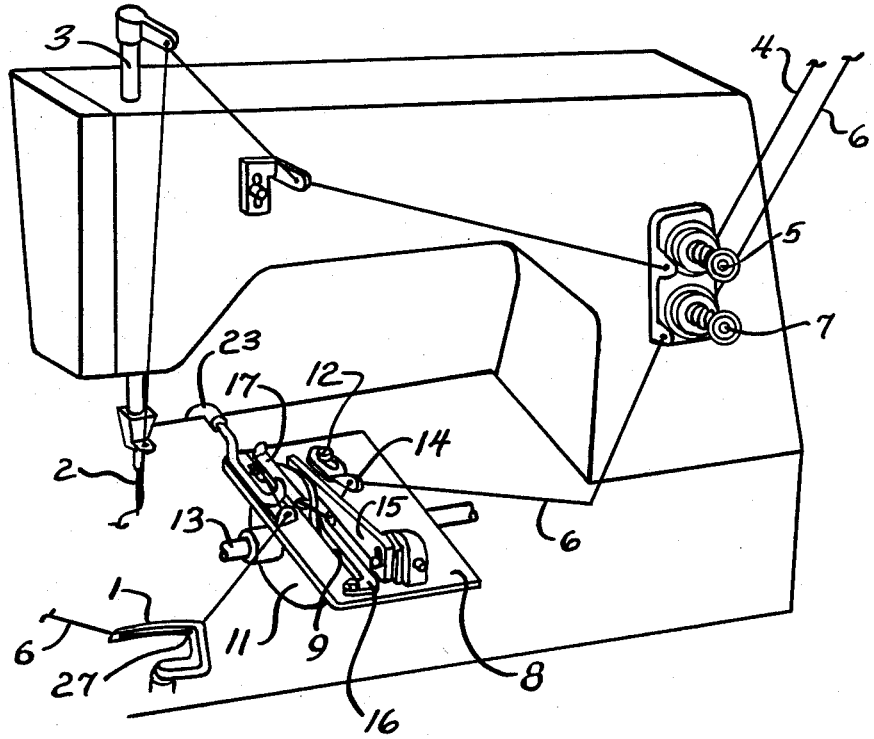
FIG. 1 is a front perspective view of a schematic representation of a sewing machine having a looper thread control device of the present invention.
Figure 2:
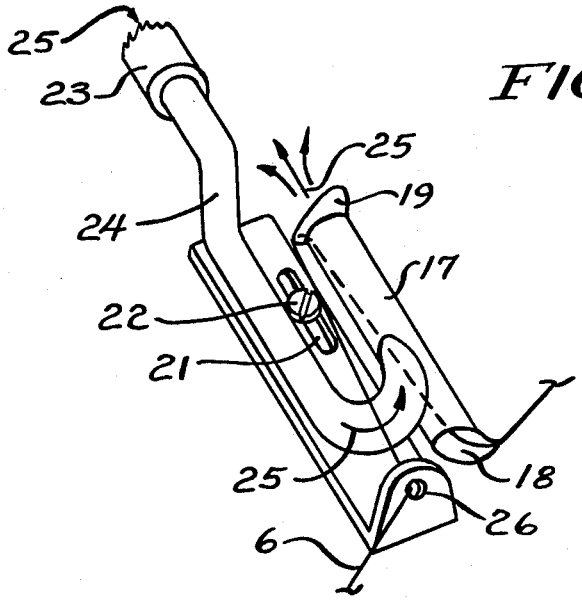
FIG. 2 is a perspective view of a tube carrying fluid medium in a looper thread control device taken on an enlarged scale.

The sewing machine shown is of conventional construction and is provided with conventional parts for producing a chain stitch seam. To do so, a looper 1 co-operates with a needle 2, which is secured to a needle bar 3 which moves up and down. The looper 1 performs a reciprocating and transverse movement in synchronism with the movement of the needle.

The needle thread 4 runs from a thread supply (not shown) through a conventional thread brake or tensioner 5 and thread guiding and control elements. The looper thread 6 also runs through a thread brake or tensioner 7 and a thread control device.

The thread control device comprises a cover plate 8 having an opening 9 for thread take-up discs 11 and 12, which are fastened to a main shaft 13. Next to the thread take-up disc 12 on the cover plate 8, there is a thread eye 14 which acts as a guide element for the looper thread 6. A thread stripping finger 15 and a wire 16 are also disposed between the thread take-up discs 11 and 12.

According to the present invention, next to the thread take-up disc 11 on the cover plate 8 there is a tube 17 having a looper thread inlet opening 18 and a looper thread outlet opening 19 which are larger than the free cross-section of the tube 17. A longitudinal hole 21 allows the tube 17 to be adjusted on the cover plate 8, and said tube 17 is secured by a screw 22.

Pressure medium, such as a stream of air flows in the direction of the arrows 25 by way of a line 23 and a bent tube 24, which opens into the tube 17 and causes the fluid medium to flow through the tube 17.

A thread eye 26, which is rigidily connected to the tube 17, guides the looper thread 6 to the thread eye 27 on the looper 1.

A pressure medium valve controls the pressure medium and hence the flow of the fluid medium through the tube 17 in synchronism with the sewing operation. As described in U.S. Pat. No. 3,788,251, page 1, lines 32 to 39 one advantageous arrangment devised for the control of the pressure meduim includes a valve disposed in the conventional tension rod system between the usual control pedal and the coupling lever of the drive of the sewing machine. The valve blocks the air supply while the sewing machine is stopped and releases the air supply as soon as the sewing machine is put in motion. This has the advantage that pressure medium is used only during sewing, as the risk of the looper thread 6 being wound around the main shaft 13 is only present during sewing.

A pressure reducer is used to adjust the pressure medium pressure in the line 23 such that the tension imparted to the looper thread 6 at least compensates for the frictional force thereof on the thread take-up discs 11 and 12, in order to prevent thread being wound up around the main shaft 13. As the pressure medium pressure required is low, and hence the consumption of pressure medium is also very low, it makes sense to adjust the pressure of the pressure medium in the line 23 such that the tension imparted to the looper thread 6 exceeds the frictional force thereof on the thread take-up discs 11 and 12. This also balances additional forces acting on the looper thread 6 and prevents thread from being wound up, as the looper thread 6 remains taut in the region of the thread take-up discs 11 and 12 even if the thread breaks, and hence does not offer any contact surface for the thread to be wound around the main shaft 13.

As pressure medium is often used in modern sewing machines, for example to cool the needles 2, the line 23 can advantageously be integrated into the control of the used pressure medium, so that there are practically no extra costs for the controls of the flow of the flow medium through the tube 17.

The foregoing detailed description is given for clearness of understanding only, and no unnecessary limitations should be understood therefrom, as modifications will be obvious to those skilled in the art.

What is claimed is:

1. A thread control device for the looper thread of a chain stitch sewing machine comprises a rotating thread take-up disc, a cover plate having a slot through which the thread take-up disc protrudes and moves between thread guiding elements into the path of the thread, and a looper having a thread eye, the thread guiding elements including a tube disposed between the thread take-up disc and the thread eye on the looper, so that the looper thread passes through the tubes means being provided for passing a pressure medium through the tube to impart tension to the looper thread to at least compensate for the frictional force of the looper thread on the thread take-up disc.

2. A thread control device as claimed in claim 1, in which the tube is connected to a line carrying pressure medium.

3. A thread control device as claimed in claim 1, in which the flow of the flow medium through the tube is controlled in synchronism with the sewing operation.

4. A thread control device for the looper thread of a chain stitch sewing machine, comprising:

a rotating thread take-up disc;

a looper having a thread eye;

a cover plate having a slot through which the thread take-up disc protrudes and moves between thread guiding elements into the path of the thread, said thread guiding elements including a tube disposed between the thread take-up disc and the thread eye on the looper such that the looper thread passes through the tube; and means for passing a pressure medium through the tube to impart tension to the looper thread to at least compensate for the frictional force of the looper thread on the thread take-up disc.

5. The thread control device of claim 4 wherein the tube is connected to a line carrying pressure medium.

6. The thread control device of claim 4 wherein the flow of the flow medium through the tube is controlled in synchronism with the sewing operation.

* * * * *